US011692781B1

(12) United States Patent
Noonan et al.

(10) Patent No.: US 11,692,781 B1
(45) Date of Patent: Jul. 4, 2023

(54) FIREARM AND A METHOD OF MANUFACTURING IT

(71) Applicant: F.M. Products Inc, Boise, ID (US)

(72) Inventors: Paul T. Noonan, Boise, ID (US); Aaron Neal Trout, Boise, ID (US)

(73) Assignee: F.M. Products Inc, Boise, ID (US)

( * ) Notice: Subject to any disclaimer, the term of this patent is extended or adjusted under 35 U.S.C. 154(b) by 0 days.

(21) Appl. No.: 17/515,114

(22) Filed: Oct. 29, 2021

Related U.S. Application Data

(60) Provisional application No. 63/108,312, filed on Oct. 31, 2020.

(51) Int. Cl.

| | |
|---|---|
| ***F41C 23/04*** | (2006.01) |
| ***F41A 3/66*** | (2006.01) |
| ***F41A 11/04*** | (2006.01) |

(52) U.S. Cl.
CPC ..... *F41A 3/66* (2013.01); *F41A 11/04* (2013.01); *F41C 23/04* (2013.01)

(58) Field of Classification Search
USPC ..... 42/75.03
See application file for complete search history.

(56) References Cited

U.S. PATENT DOCUMENTS 10,704,848 B1 * 7/2020 Zeider ..... F41A 3/66

* cited by examiner

*Primary Examiner* — Reginald S Tillman, Jr.

(57) ABSTRACT

A receiver and a method for manufacturing it are disclosed. The receiver contains an assembly pivotally coupled with the lower receiver, a buttstock coupled with the assembly, wherein the assembly is configured to move from a locked position to a folded position and back to the locked position.

6 Claims, 16 Drawing Sheets

FIREARM AND A METHOD OF MANUFACTURING IT

CROSS REFERENCE TO RELATED APPLICATIONS

This application claims the benefit of U.S. Provisional Application No. 63/108,312, filed on Oct. 31, 2020, which is incorporated herein by reference in its entirety.

FIELD

The present invention relates to firearm. More particularly, the present invention relates to a firearm and a method of manufacturing it.

BACKGROUND

The AR15/M16 family of firearms and their derivatives, have folding stocks. Folding stocks on rifles, particularly rifles with longer barrels, allow the user to transport or store the firearm more conveniently and in a smaller container. Folding stock mechanisms provide a means of locking the buttstock in the folded position to prevent accidental or unwanted movement which might cause inconvenience, noise or possible injury if pinched.

There are a number of common problems with prior art folding stocks, including they are expensive to manufacture. Therefore, a need exists for a better type of folding mechanism for firearms.

DETAILED DESCRIPTION

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Figure 1:
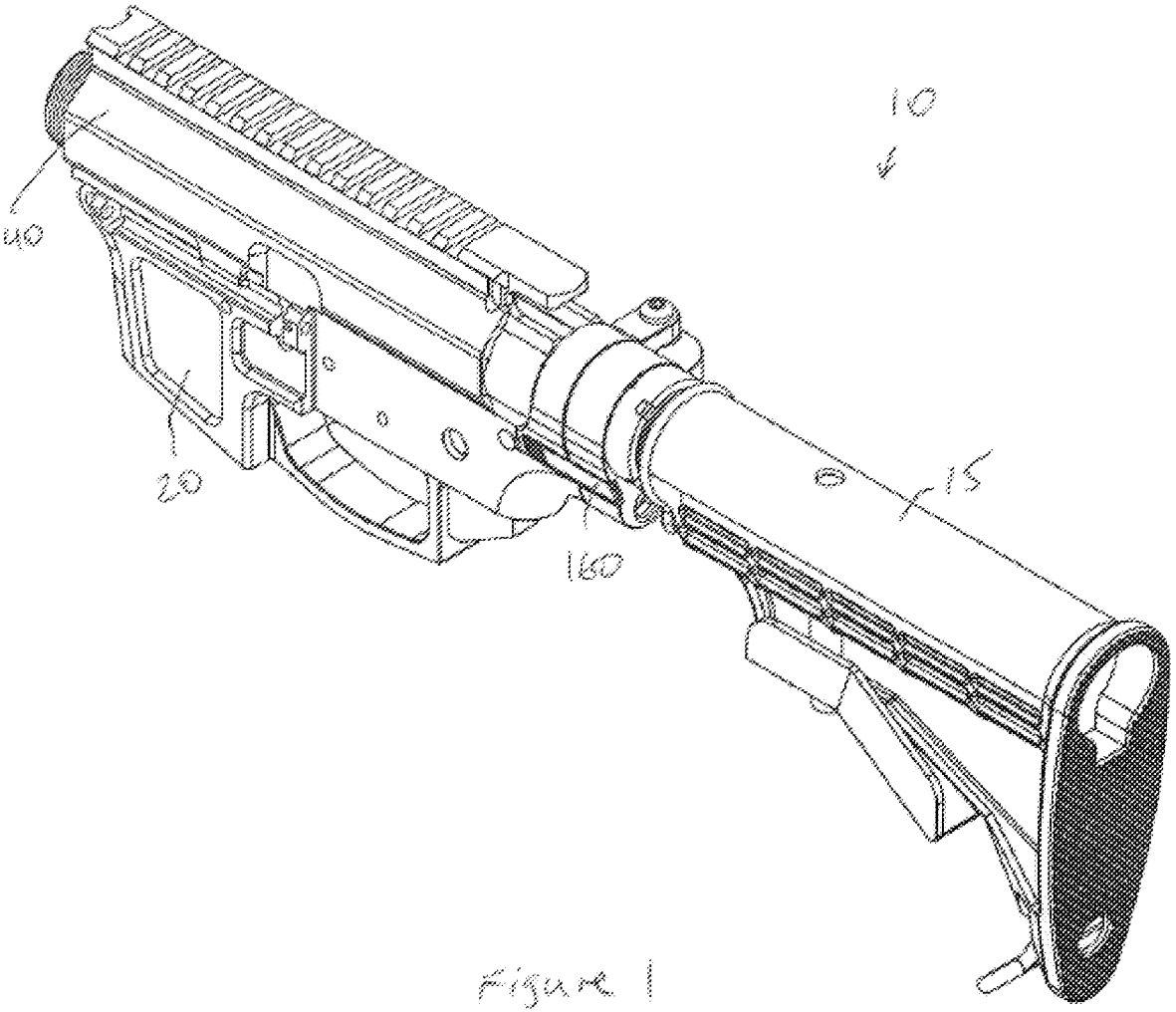
FIG. 1 depicts a partial view of a firearm according to some embodiments presently disclosed.
Figure 2:
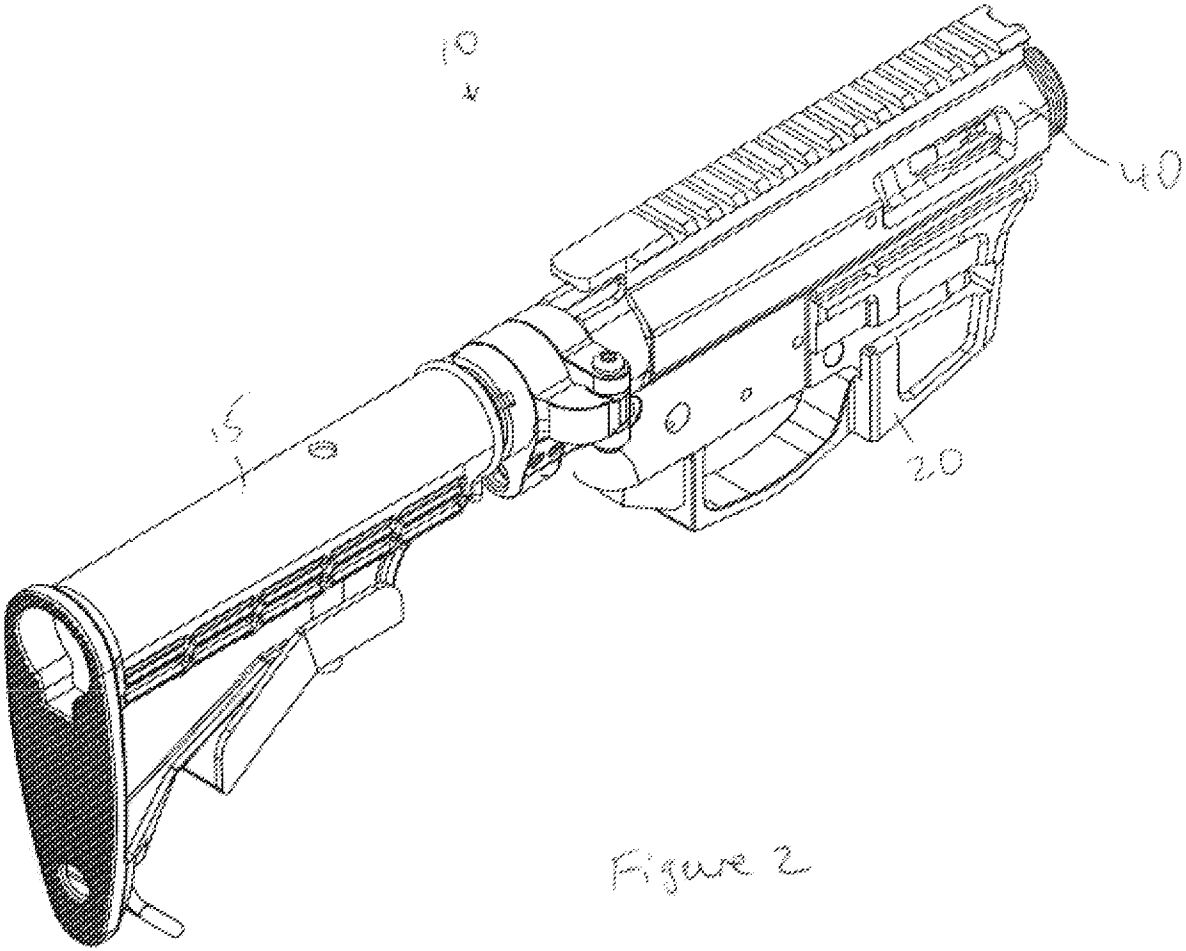
FIG. 2 depicts a partial view of a firearm according to some embodiments presently disclosed.
Figure 3:
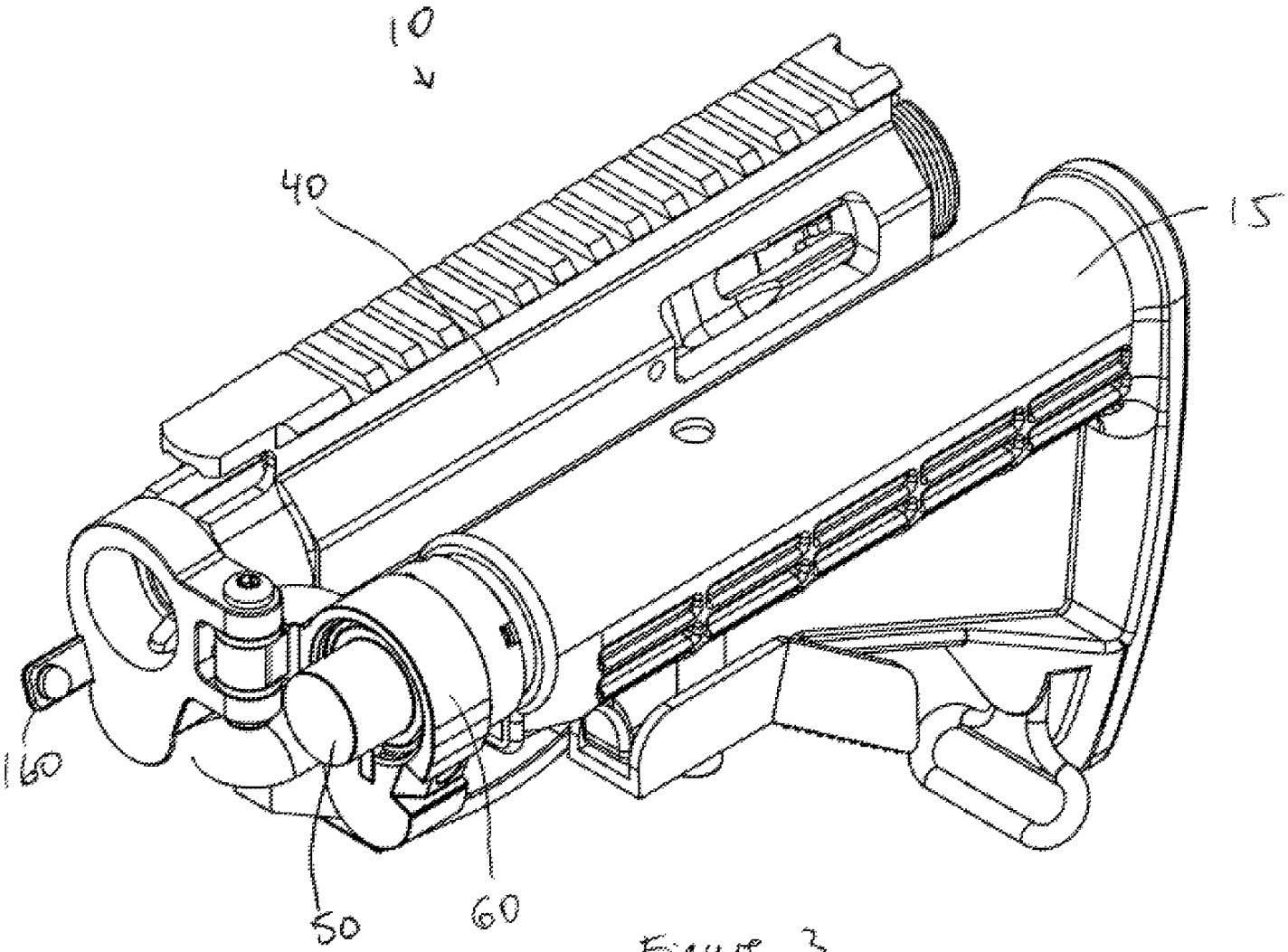
FIG. 3 depicts a folded, partial view of a firearm according to some embodiments presently disclosed.
Figure 4:
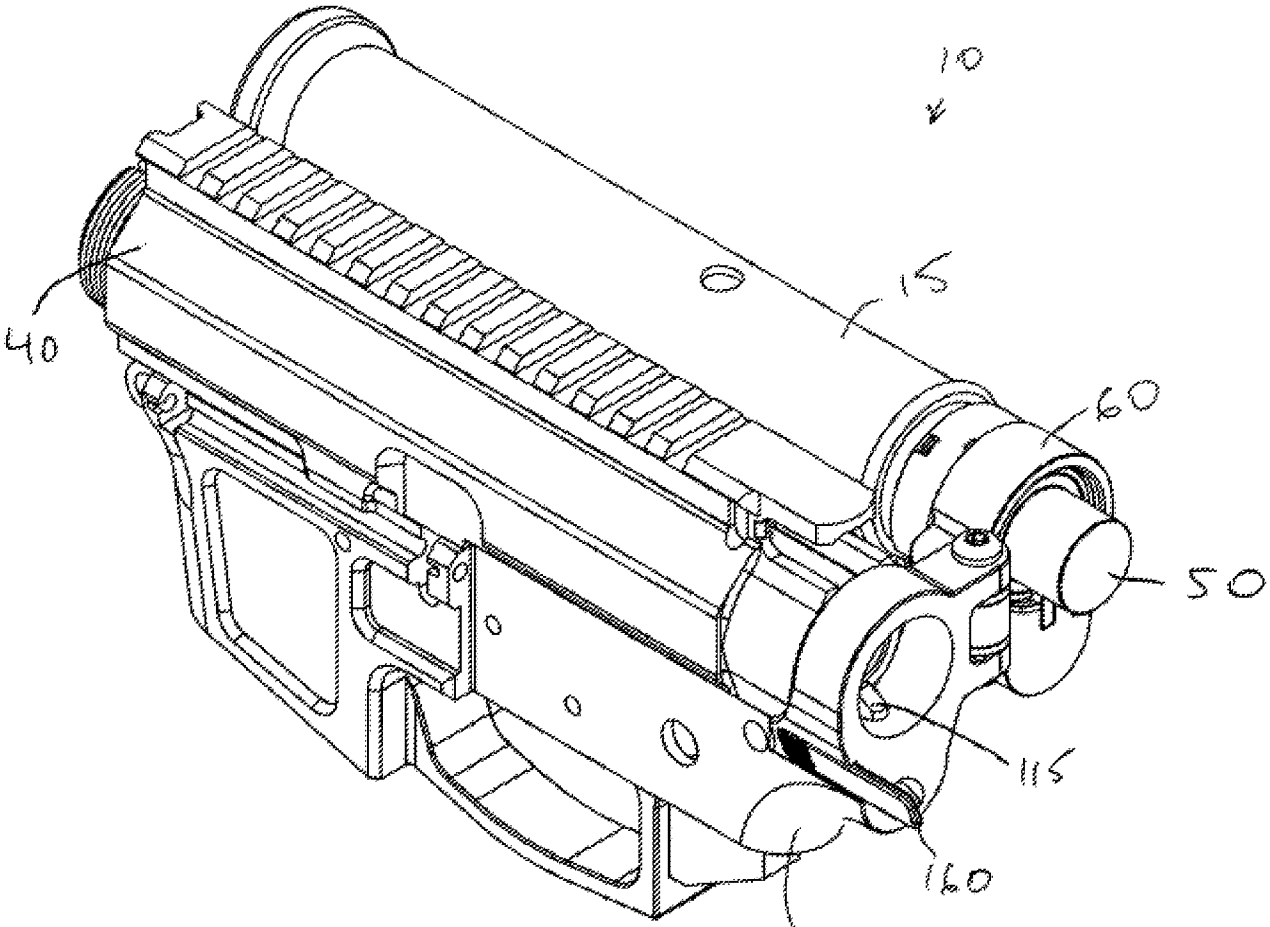
FIG. 4 depicts a folded, partial view of a firearm according to some embodiments presently disclosed.

Referring to FIGS. 1-2, a portion of a firearm 10 is shown according to the present disclosure wherein a buttstock 15 in a locked position with respect to a lower receiver 20. Referring to FIGS. 3-4, the portion of the firearm 10 is shown according to the present disclosure wherein the buttstock 15 in a folded position with respect to the lower receiver 20.

Figure 5:
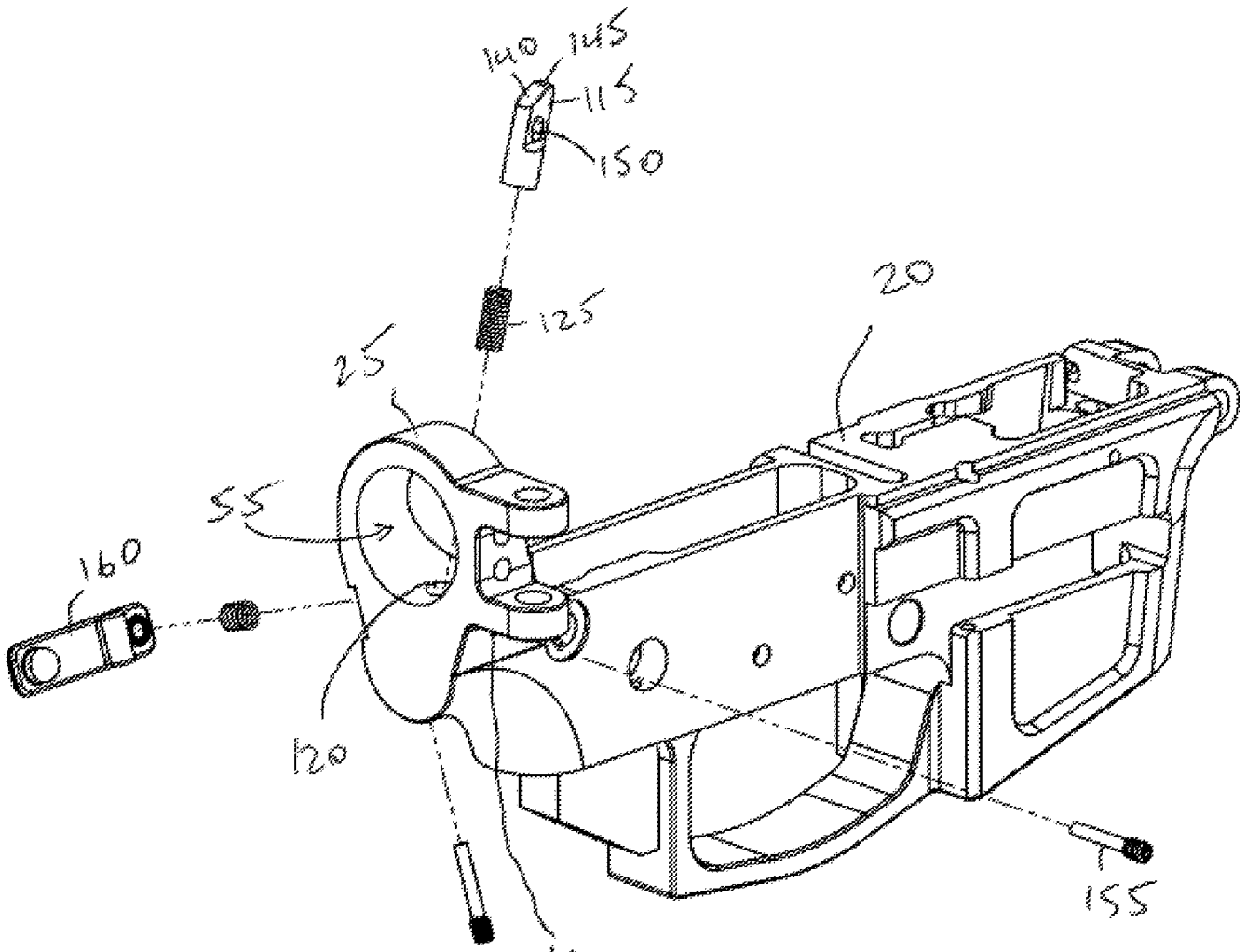
FIG. 5 depicts a partial view of a firearm according to some embodiments presently disclosed.

Referring to FIG. 5, an exploded view of the lower receiver 20 for the firearm 10 is shown according to the present disclosure. The lower receiver 20 comprises an upwardly extending lobe 25. According to some embodiments, the upwardly extending lobe 25 is used to mount the buttstock 15 to the lower receiver 20 and is used to align a receiver extension 30 (shown in FIG. 6) with a bolt carrier 35 (shown in FIGS. 10-15) housed within an upper receiver 40. The receiver extension 30 generally houses an action (or recoil) spring 45 (shown in FIG. 6) and a buffer assembly 50 (shown in FIG. 6). Upon discharge of a round, the bolt carrier 35 within the upper receiver 40 is driven rearward by action of the gas discharged by the firing action. The buffer assembly 50 and the action spring 45 dampen the kickback experienced by a user while also redirecting the firing mechanism back toward the chamber in preparation for firing another round.

According to some embodiments, the upwardly extending lobe 25 is integral with the lower receiver 20. According to some embodiments, the upwardly extending lobe 25 extends from the lower receiver 20. According to some embodiments, the upwardly extending lobe 25 is integral with the lower receiver 20 and is made of the same material as the lower receiver 20. According to some embodiments, the upwardly extending lobe 25 and the lower receiver 20 are made from aluminum, steel, or polymer. According to some embodiments, the upwardly extending lobe 25 and the lower receiver 20 are made from a single piece of aluminum, a single piece of steel, or a single piece of polymer. According to some embodiments, the upwardly extending lobe 25 and the lower receiver are machined from a single piece of material. According to some embodiments, the upwardly extending lobe 25 and the lower receiver 20 are formed from a single piece of material.

According to some embodiments, the upwardly extending lobe 25 comprises a generally circular through-hole 55 configured to accommodate at least a portion of the bolt carrier 35.

Figure 6:
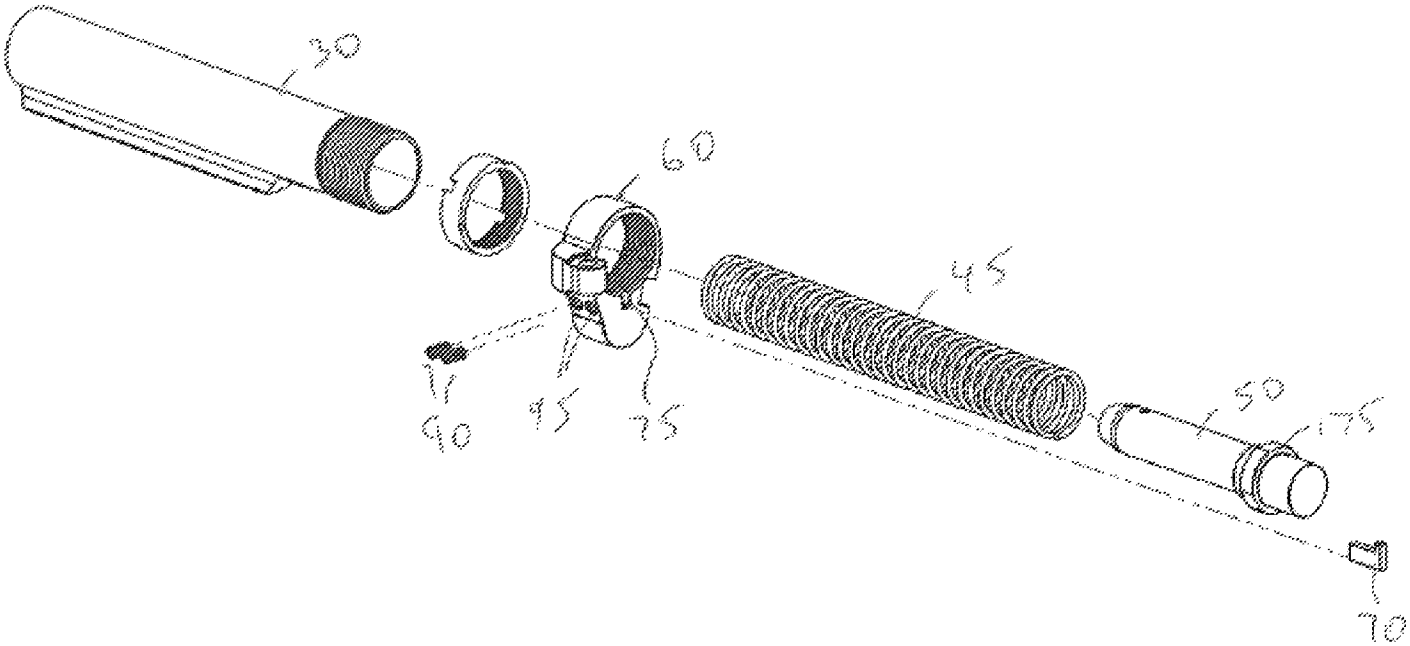
FIG. 6 depicts an exploded view of the invention according to some embodiments presently disclosed.

According to some embodiments presently disclosed, an assembly 60 is shown in FIGS. 3-4 and 6. According to some embodiments presently disclosed, the assembly 60 is hingly coupled with the upwardly extending lobe 25. According to some embodiments presently disclosed, the assembly 60 is pivotally coupled with the upwardly extending lobe 25. According to some embodiments presently disclosed, the assembly 60 is coupled with the upwardly extending lobe 25. According to some embodiments presently disclosed, the assembly 60 is coupled with the upwardly extending lobe 25 and the assembly 60 is configured to move from a first (locked) position to a second (folded) position with respect to the upwardly extending lobe 25. According to some embodiments presently disclosed, the assembly 60 is coupled with the upwardly extending lobe 25 and the assembly 60 is configured to move from a first (locked) position to a second (folded) position with respect to the lower receiver 20.

According to some embodiments presently disclosed, the first (locked) position aligns the receiver extension 30 with the bolt carrier 35 housed within the upper receiver 40. According to some embodiments presently disclosed, upon discharge of the round, the bolt carrier 35 within the upper receiver 40 is driven rearward by action of the gas discharged by the firing action. According to some embodiments presently disclosed, upon discharge of the round, the bolt carrier 35 within the upper receiver 40 is partially driven into the receiver extension 30.

According to some embodiments presently disclosed, the second (folded) position is any position that is away from the first (locked) position. According to some embodiments presently disclosed, the second (folded) position prevents alignment of the receiver extension 30 with the bolt carrier 35 housed within the upper receiver 40.

Figure 9:
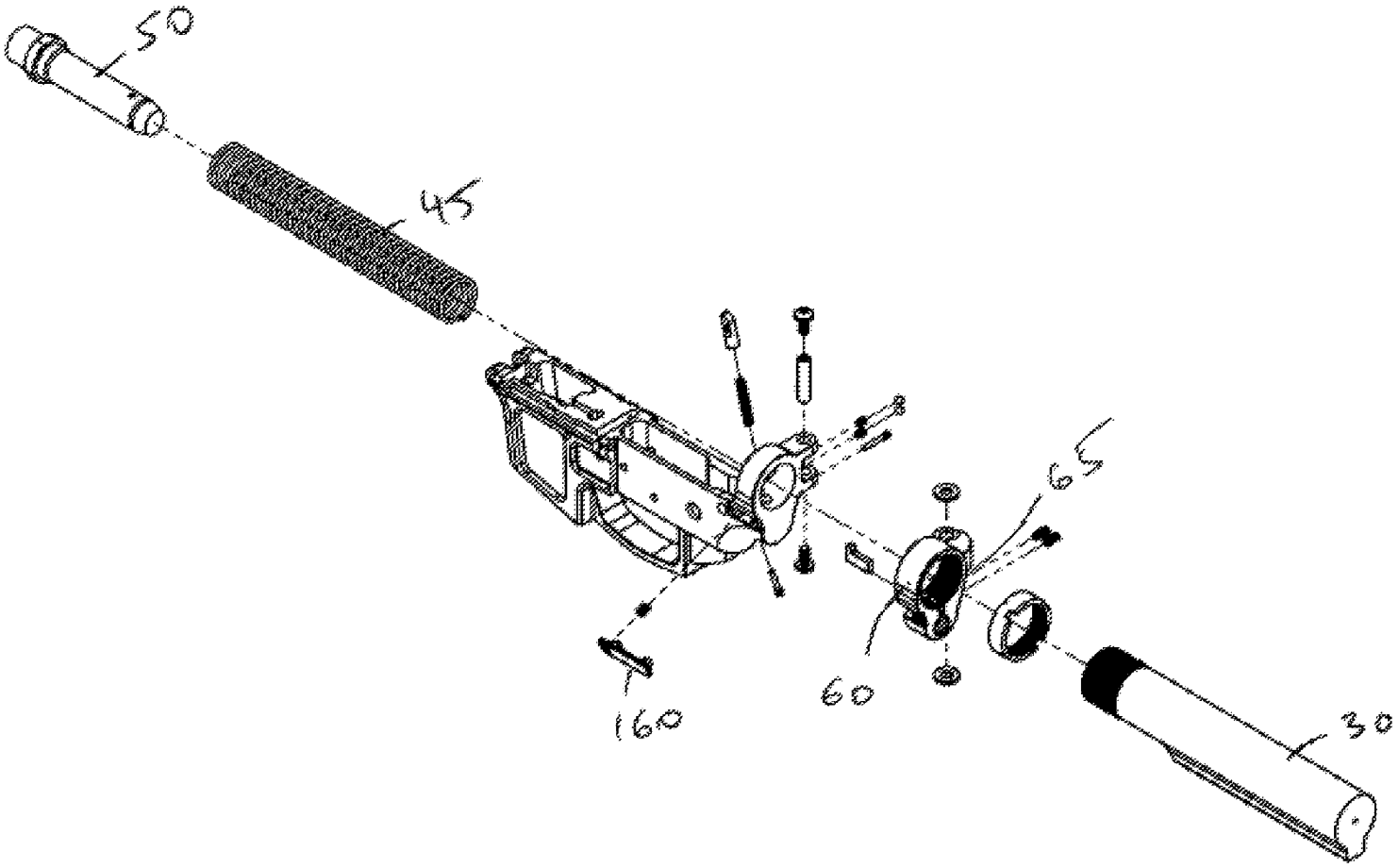
FIG. 9 depicts an exploded view of the invention according to some embodiments presently disclosed.

According to some embodiments, the assembly 60 comprises a generally circular threaded through-hole 65 (shown in FIG. 9). adapted to receive the mating male threads on the receiver extension 30.

Figure 7:
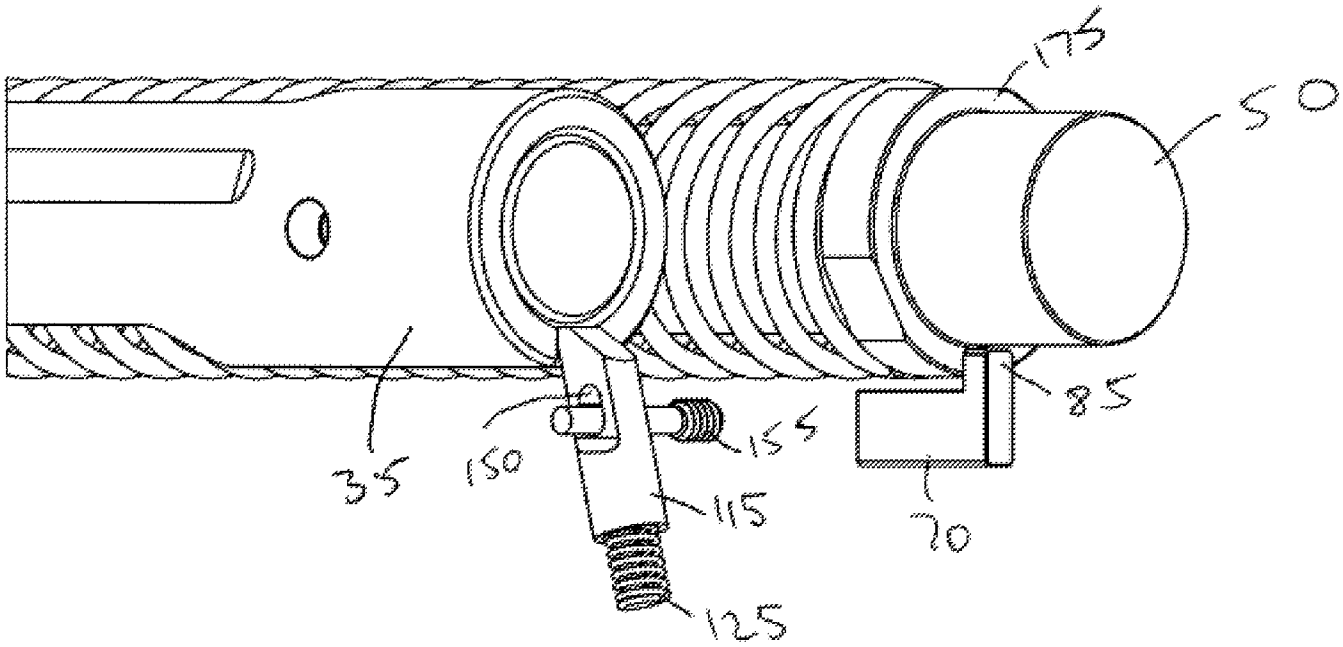
FIG. 7 depicts a partial view of the invention according to some embodiments presently disclosed.
Figure 12:
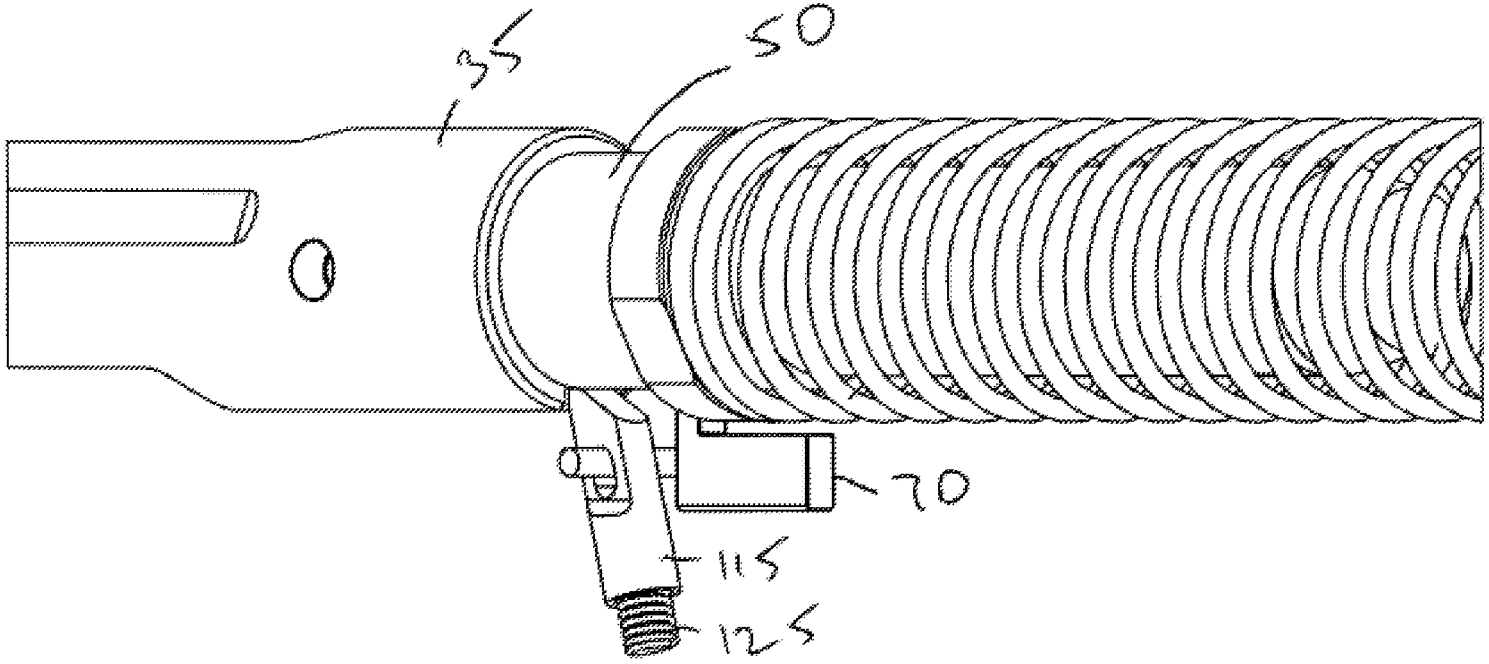
FIG. 12 depicts a partial view of the invention according to some embodiments presently disclosed.
Figure 13:
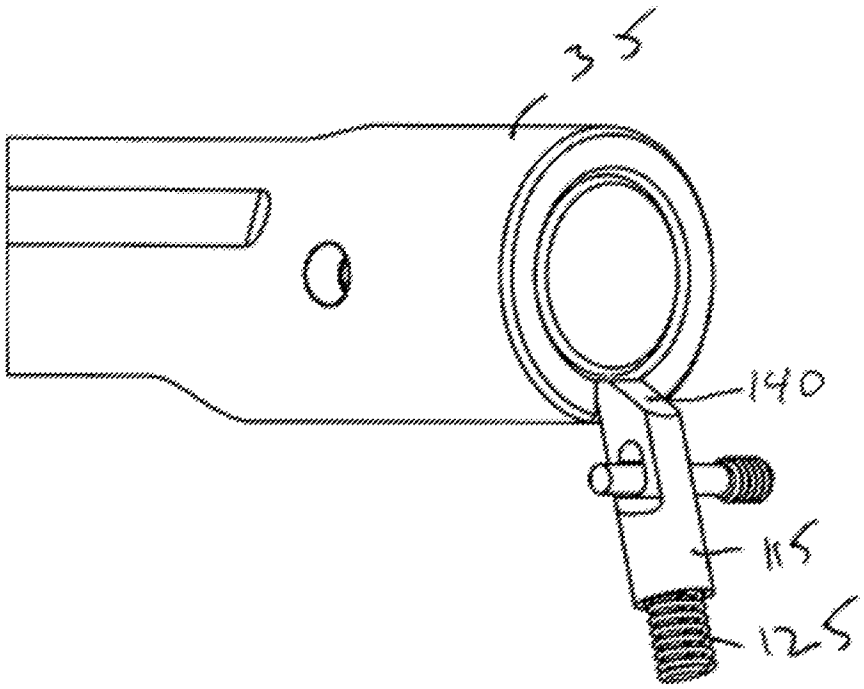
FIG. 13 depicts a partial view of the invention according to some embodiments presently disclosed.

According to some embodiments presently disclosed, a stopper 70 is shown in the FIGS. 7 and 12. The stopper 70 is configured to prevent the buffer assembly 50 from being removed from the receiver extension 30. According to some embodiments, the assembly 60 comprises an aperture 75 (shown in FIG. 6) configured to accommodate at least a portion of the stopper 70. One or more fasteners 90 may be used to retain at least a portion of the stopper 70 within the aperture 75. The stopper 75 may comprise a protrusion 85 (shown in FIG. 7) configured to abut the buffer assembly 50.

According to some embodiments, the assembly 60 comprises one or more apertures 95 configured to accommodate the one or more fasteners 90. The fasteners 90 may be screws, pins, socket head cap screws. The fasteners 90 are configured to removably couple the stopper 70 with the assembly 60.

Figure 8:
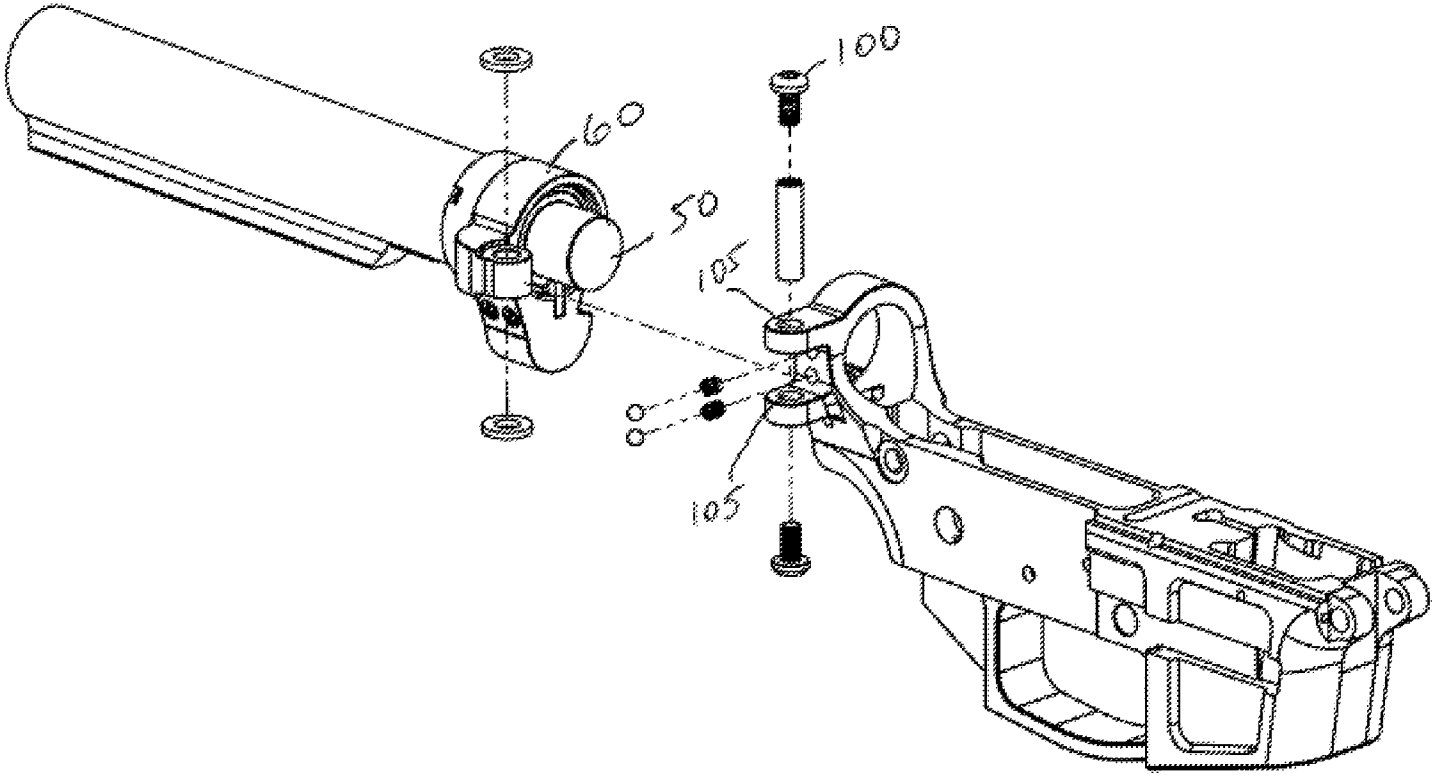
FIG. 8 depicts an exploded view of the invention according to some embodiments presently disclosed.

According to some embodiments, the assembly 60 is coupled with the upwardly extending lobe 25 with one or more fasteners 100 (shown in FIG. 8). According to some embodiments, the upwardly extending lobe 25 comprises one or more apertures 105 (shown in FIG. 8) configured to accommodate the one or more fasteners 100. The fasteners 100 may be screws, pins, socket head cap screws. The fasteners 100 are configured to pivotally couple the assembly 60 with the upwardly extending lobe 25.

According to some embodiments presently disclosed, a movable stopper 115 is shown in FIGS. 5, 7 and 10-16. According to some embodiments, the upwardly extending lobe comprises an aperture 120 (shown in FIG. 10) configured to accommodate the movable stopper 115.

According to some embodiments presently disclosed, the movable stopper 115 is configured to move from a first (blocking) position to a second (open) position. According to some embodiments presently disclosed, the first (blocking) position prevents the bolt carrier 35 from moving beyond the upwardly extending lobe 25. According to some embodiments presently disclosed, the second (open) position allows the bolt carrier 35 to move beyond the upwardly extending lobe 25.

According to some embodiments presently disclosed, when the assembly 60 is in the first (locked) position (shown in FIG. 11), a first end of the buffer assembly 50 moves the movable stopper 115 from the first (blocking) position to the second (open) position. According to some embodiments presently disclosed, when the assembly 60 is in the first (locked) position, the movable stopper 115 is in the second (open) position. According to some embodiments presently disclosed, when the assembly 60 is moved from the second (folded) position to the first (locked) position, a first end of the buffer assembly 50 moves the movable stopper 115 from the first (blocking) position to the second (open) position.

Figure 10:
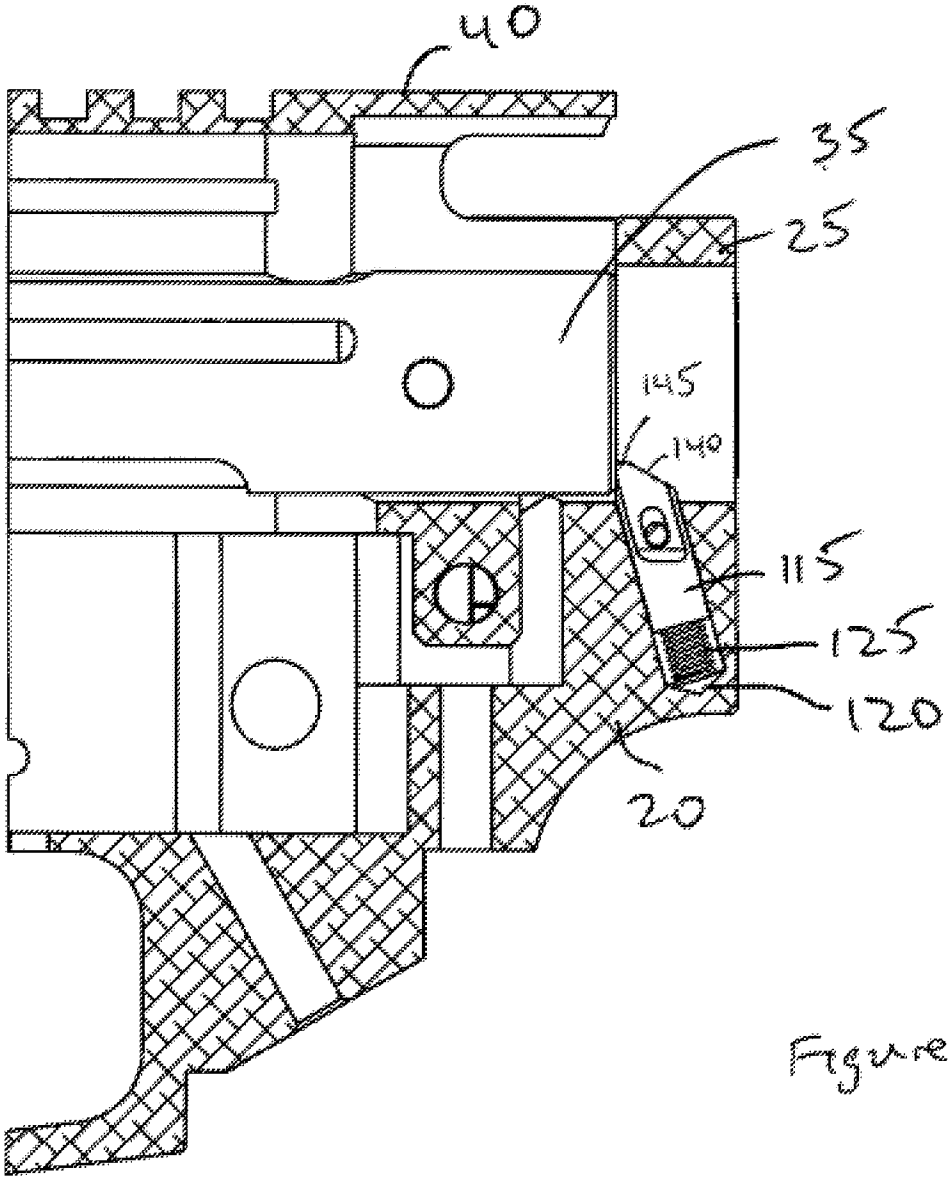
FIG. 10 depicts a cutaway view of the invention according to some embodiments presently disclosed.
Figure 11:
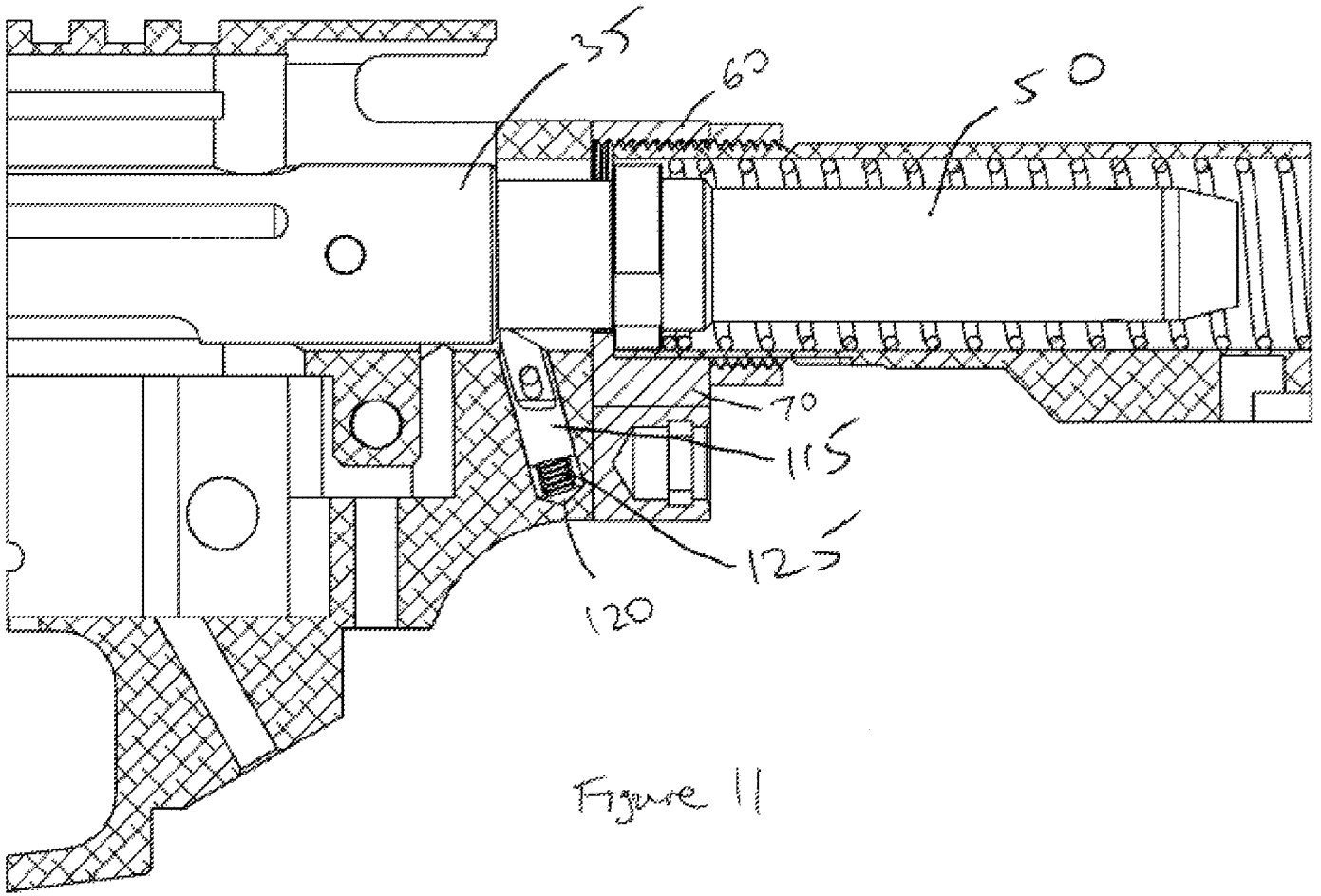
FIG. 11 depicts a cutaway view of the invention according to some embodiments presently disclosed.

According to some embodiments presently disclosed, when the assembly 60 is moved from the first (locked) position to the second (folded) position, the movable stopper 115 moves from the second (open) position to the first (blocking) position (shown in FIG. 10). According to some embodiments presently disclosed, when the assembly 60 is in the second (folded) position, the movable stopper 115 is in the first (blocking) position (shown in FIG. 10).

According to some embodiments, a spring member 125 is configured to apply a first force to the movable stopper 115 when the movable stopper 115 is in the first (blocking) position. According to some embodiments, the spring member 125 is configured to apply a second force to the movable stopper 115 when the movable stopper 115 is in the second (open) position. According to some embodiments, the second force is greater than the first force.

According to some embodiments, the spring member 125 is configured to push (i.e. urge) the movable stopper 115 from the second (open) position, the first (locked) position. According to some embodiments, the spring member 125 is compressed when the movable stopper 115 is in the second (open) position.

According to some embodiments presently disclosed, the first end of the buffer assembly 50 moves the movable stopper 115 from the first (blocking) position to the second (open) position against the first force when the assembly 60 is in the first (locked) position.

According to some embodiments presently disclosed, the movable stopper 115 comprises a sloped surface 140 (shown in FIGS. 10 and 13) and a top surface 145 (shown in FIG. 10). According to some embodiments presently disclosed, the buffer assembly 50 moves along the sloped surface 140 and is positioned on the top surface 145 (shown in FIG. 11) when the assembly 60 is moved from the second (folded) position to the first (locked) position. The movable stopper 115 moves from the first (blocking) position to the second (open) position as the buffer assembly 50 moves along the sloped surface 140 towards the top surface 145.

According to some embodiments presently disclosed, the movable stopper 115 comprises an aperture 150 configured to accommodate a fastener 155 (shown in FIG. 7).

According to some embodiments, the upwardly extending lobe 25 comprises an aperture configured to accommodate the fastener 155. According to some embodiments, the fastener 155 is configured to retain the movable stopper 115 and the spring member 125 within the aperture 120. According to some embodiments, the aperture 150 is non-circular in shape to allow the movable stopper 115 to move from the first (blocking) position to the second (open) position and back.

Figure 14:
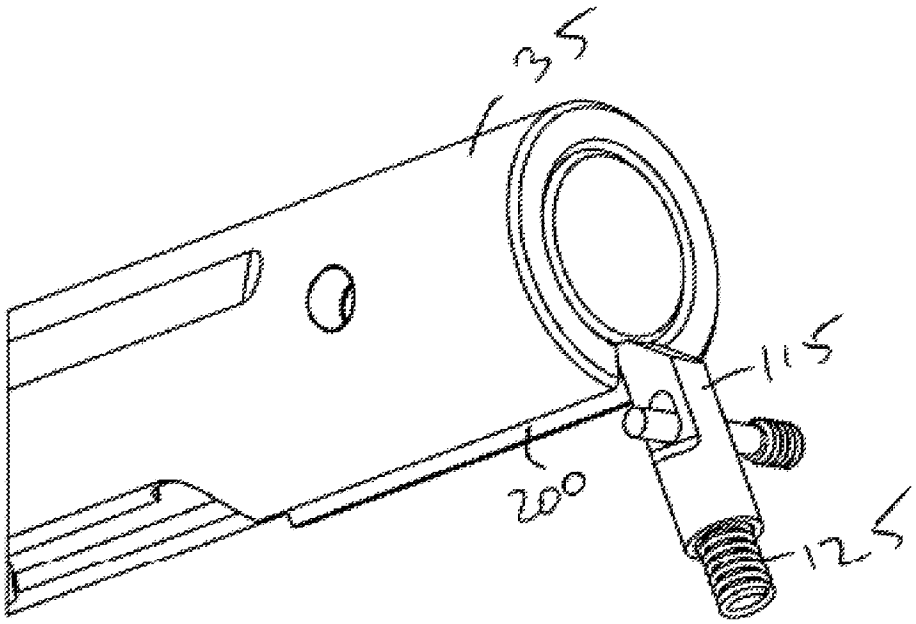
FIG. 14 depicts a partial view of the invention according to some embodiments presently disclosed.
Figure 15:
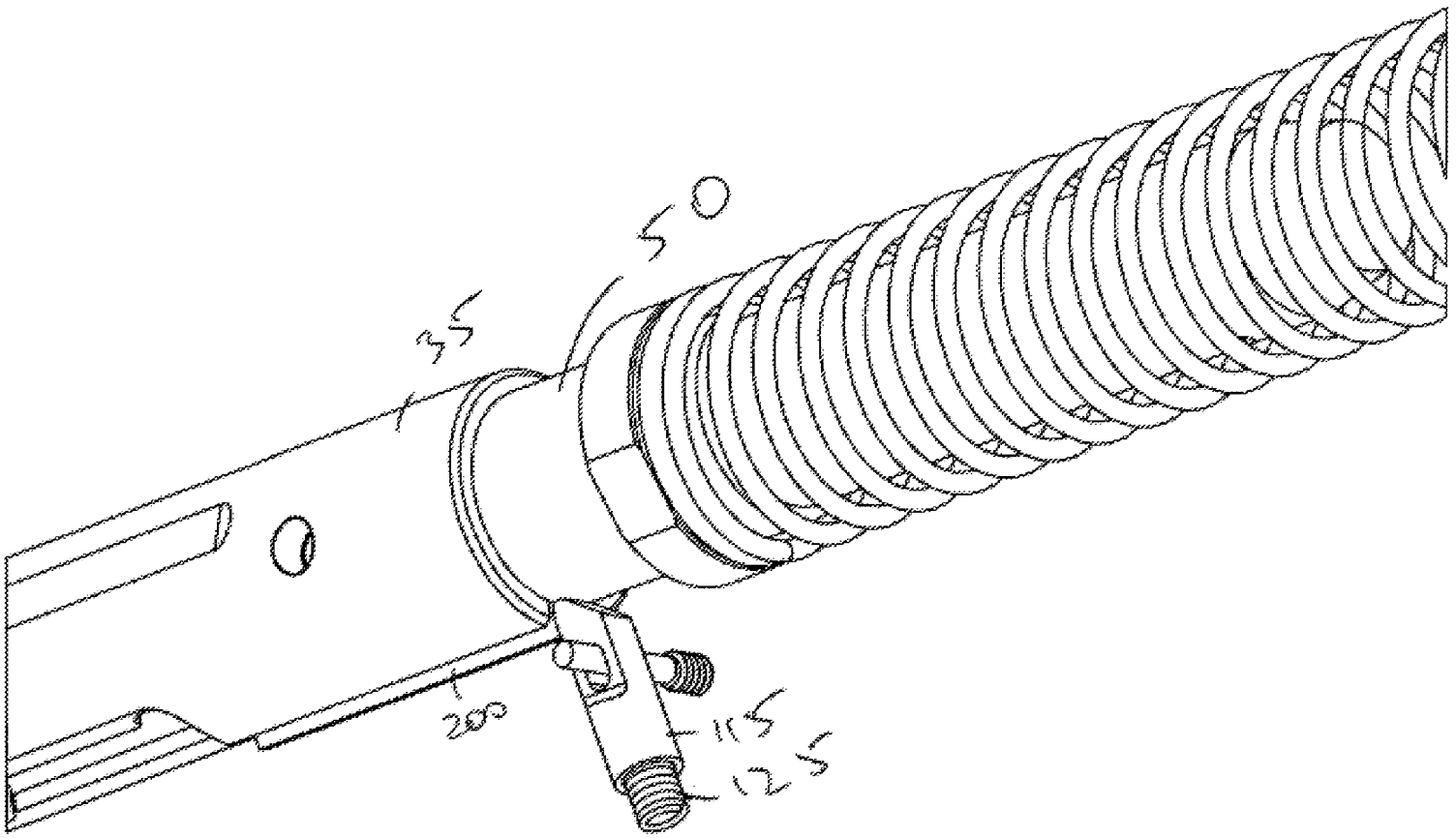
FIG. 15 depicts a partial view of the invention according to some embodiments presently disclosed.
Figure 16:
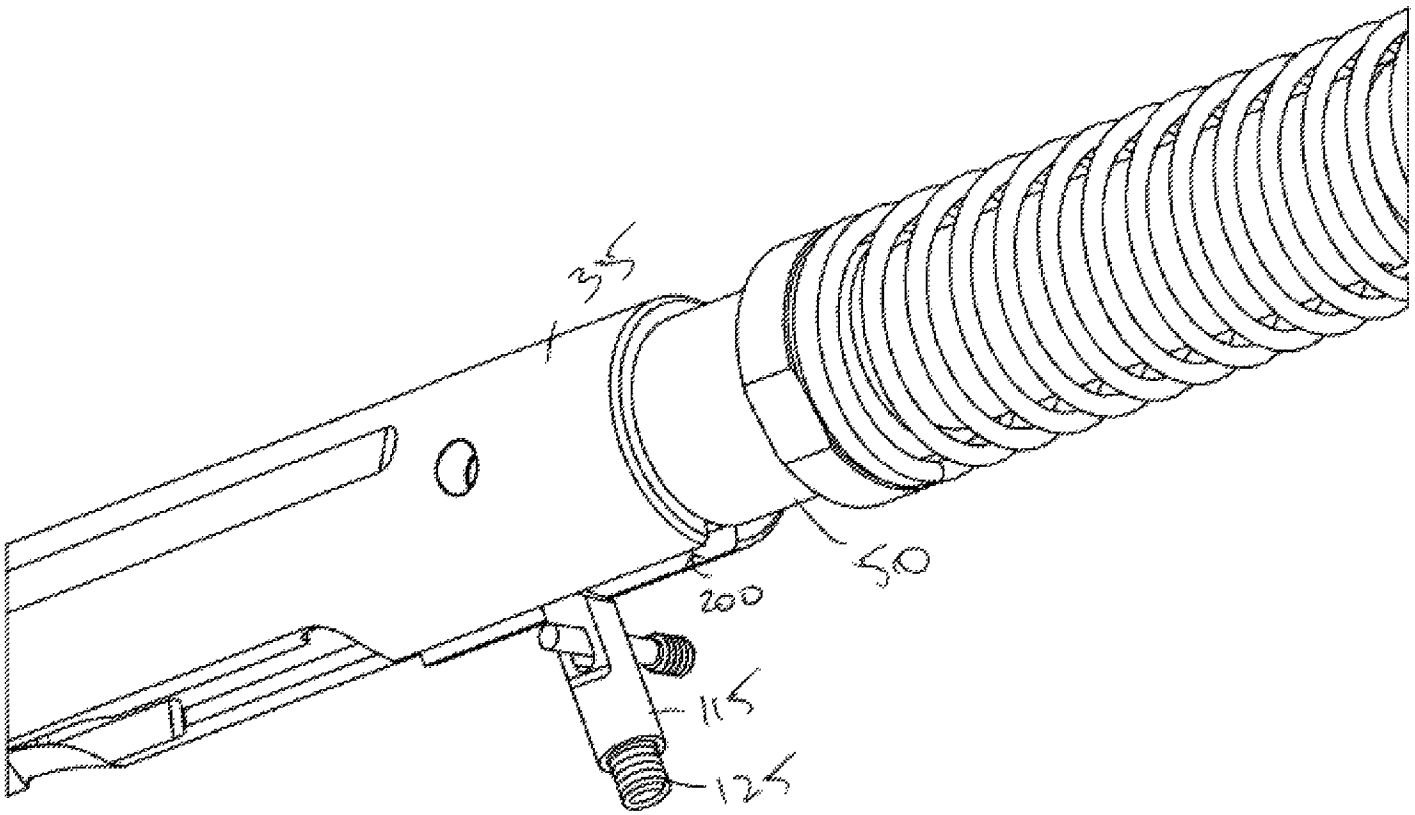
FIG. 16 depicts a partial view of the invention according to some embodiments presently disclosed.

According to some embodiments, the bolt carrier 35 comprises a channel 200 as shown in FIGS. 14-16. According to some embodiments, the channel 200 is configured to accommodate a portion of the movable stopper 115 to allow the bolt carrier 35 to move over the stopper 115 when the bolt carrier 35 is driven rearward by action of the gas discharged by the firing action upon discharge of a round (shown in FIG. 16). According to some embodiments, the channel 200 is configured to accommodate a portion of the movable stopper 115 when the movable stopper is in the second (open) position (shown in FIG. 16).

According to some embodiments, a locking assembly 160 is configured to prevent the assembly 60 from being moved from the first (locked) position to the second (folded) position. According to some embodiments, the locking assembly 160 is a latch. According to some embodiments, the locking assembly 160 must be pressed to allow the assembly 60 to be moved from the first (locked) position to the second (folded) position.

According to some embodiments, the locking assembly 160 must be released to allow the assembly 60 to be moved from the first (locked) position to the second (folded) position. According to some embodiments, the buffer assembly 50 comprises a protruding surface 175 (shown in FIG. 7) configured to abut the stopper 70. According to some embodiments, the buffer assembly 50 comprises a protruding surface 175 (shown in FIG. 7) configured to abut the protrusion 85 of the stopper 70. According to some embodiments, the stopper 70 only allows a portion of the buffer assembly 50 to protrude beyond the assembly 60.

According to some embodiments presently disclosed, the first material is steel, aluminum, metal, polymer, and/or sintered metal powder. According to some embodiments presently disclosed, the second material is steel, aluminum, metal, polymer, and/or sintered metal powder. According to some embodiments presently disclosed, the first melting point is lower than the second melting point.

While several illustrative embodiments of the invention have been shown and described, numerous variations and alternative embodiments will occur to those skilled in the art. Such variations and alternative embodiments are contemplated, and can be made without departing from the scope of the invention as defined in the appended claims.

As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

What is claimed is:

1. A lower receiver comprising:

an assembly pivotally coupled with the lower receiver;

a buffer assembly; and a stopper movable between a blocking position and an open position, wherein the stopper prevents rearward movement of a bolt carrier when the stopper is in the blocking position, wherein the stopper allows rearward movement of the bolt carrier when the stopper is in the open position;

wherein the assembly is configured to move from a locked position to a folded position and back to the locked position;

wherein the buffer assembly moves the stopper to the open position when the assembly is in the locked position.

2. The lower receiver of claim 1, wherein the assembly is pivotally coupled with an upwardly extending lobe.

3. The lower receiver of claim 1, wherein the upwardly extending lobe is integral with the lower receiver.

4. A firearm comprising:

an upper receiver, a lower receiver removably coupled with the upper receiver;

a bolt carrier housed within the upper receiver;

an assembly pivotally coupled with the lower receiver, wherein the assembly is configured to move from a locked position to a folded position and back to the locked position;

a receiver extension coupled with the assembly;

a buffer assembly associated with the receiver extension; and a stopper movable between a blocking position and an open position, wherein the receiver extension aligns with the bolt carrier when the assembly is in the locked position to allow at least a portion of the bolt carrier to move into the receiver extension upon discharge of a round when the stopper is in the open position;

wherein the bolt carrier is prevented from moving into the receiver extension by the stopper when the stopper is in the blocking position and the assembly is in the folded position;

wherein the buffer assembly moves the stopper to the open position when the assembly is in the locked position.

5. The lower receiver of claim 1, wherein the buffer assembly abuts the stopper when the assembly is in the locked position.

6. The firearm of claim 4, wherein the buffer assembly abuts the stopper when the assembly is in the locked position.

* * * * *